US009459575B2

(12) United States Patent
Matsushita

(10) Patent No.: US 9,459,575 B2
(45) Date of Patent: Oct. 4, 2016

(54) TEMPERATURE-BASED ROTATIONAL SPEED CONTROL FOR A DEVELOPING ROLLER IN AN IMAGE FORMING APPARATUS

(71) Applicant: Brother Kogyo Kabushiki Kaisha, Nagoya-shi, Aichi-ken (JP)

(72) Inventor: Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/924,791

(22) Filed: Oct. 28, 2015

(65) Prior Publication Data

US 2016/0116877 A1 Apr. 28, 2016

(30) Foreign Application Priority Data

Oct. 28, 2014 (JP) ..... 2014-219701
Oct. 19, 2015 (JP) ..... 2015-205338

(51) Int. Cl.
*G03G 15/08* (2006.01)
*G03G 15/00* (2006.01)
*G03G 21/20* (2006.01)

(52) U.S. Cl.
CPC ..... *G03G 15/50* (2013.01); *G03G 15/5058* (2013.01); *G03G 21/20* (2013.01); *G03G 2215/00084* (2013.01); *G03G 2215/0141* (2013.01)

(58) Field of Classification Search
CPC .. G03G 15/50; G03G 15/0887; G03G 21/20; G03G 15/5058; G03G 2215/00084; G03G 2215/0141
USPC ..... 399/53
See application file for complete search history.

(56) References Cited

FOREIGN PATENT DOCUMENTS

JP 06035312 A * 2/1994
JP 2002-357934 A 12/2002

* cited by examiner

*Primary Examiner* — Billy Lactaoen
(74) *Attorney, Agent, or Firm* — Banner & Witcoff, Ltd.

(57) ABSTRACT

An image forming apparatus including a control device configured to predict, before printing a print job, whether or not a temperature of developer carried on a developing roller during the printing of the print job, in which the developing roller is rotated at a predetermined rotational speed, becomes equal to or higher than a first predetermined value by using a temperature detected by a temperature detector, rotate the developing roller at the predetermined rotational speed in a case where the predicted temperature does not become equal to or higher than the first predetermined value, and rotate the developing roller at a low speed lower than the predetermined rotational speed from a start to an end of the printing of the print job in a case where the predicted temperature becomes equal to or higher than the first predetermined value.

12 Claims, 7 Drawing Sheets

1
10
12
13
15
16
20
21
22
23
24
25
26
27
30
40
50K
50C
50Y
51
52
53
54
55
56
70
71
72
73
74
75
80
81
82
100
103
104
S
CONTROL DEVICE
UPPER
LOWER
FRONT
REAR

TEMPERATURE-BASED ROTATIONAL SPEED CONTROL FOR A DEVELOPING ROLLER IN AN IMAGE FORMING APPARATUS

CROSS-REFERENCE TO RELATED APPLICATIONS

This application claims priority from Japanese Patent Application No. 2014-219701 filed on Oct. 28, 2014, and Japanese Patent Application No. 2015-205338 filed on Oct. 19, 2015, the entire contents of which are incorporated herein by reference.

BACKGROUND

As a technology for suppressing melting of toner, which is caused by a continuous high-speed rotation of a developing roller in a high-temperature environment, there is known a technology for reducing a rotational speed of the developing roller in a case where a temperature inside an image forming apparatus becomes a high temperature during printing of a print job.

However, when the rotational speed of the developing roller is reduced during the printing of the print job, there occurs a difference in an image quality of the print job between a print result before the rotational speed of the developing roller is reduced and a print result after the rotational speed of the developing roller is reduced. Accordingly, there is a possibility that the unity in the image quality of the print job is lost.

SUMMARY

Accordingly, the disclosure aims to prevent the unity in an image quality of a print job from being lost while suppressing the melting of toner in a high-temperature environment.

According to an aspect of the disclosure, there is provided an image forming apparatus including: a photosensitive member whose surface is configured to be charged; an exposure device configured to form an electrostatic latent image on the photosensitive member; a container configured to contain developer therein; a developing roller configured to supply the developer contained in the container to the surface of the photosensitive member; a control device configured to control a rotational speed of the developing roller; and a temperature detector configured to detect temperature, wherein the control device is configured to predict, before printing a print job, whether or not a temperature of the developer carried on the developing roller during the printing of the print job, in which the developing roller is rotated at a predetermined rotational speed, becomes equal to or higher than a first predetermined value by using the temperature detected by the temperature detector, rotate the developing roller at the predetermined rotational speed at least at a start of the printing of the print job in a case where it is predicted that the temperature of the developer carried on the developing roller during the printing of the print job does not become equal to or higher than the first predetermined value, and rotate the developing roller at a low speed lower than the predetermined rotational speed from the start to an end of the printing of the print job in a case where it is predicted that the temperature of the developer carried on the developing roller during the printing of the print job becomes equal to or higher than the first predetermined value.

According to another aspect of the disclosure, there is provided a control method of controlling, by a control device, a rotational speed of a developing roller configured to supply developer to a surface of a photosensitive member, the control method including: predicting, before printing a print job, whether or not a temperature of the developer carried on the developing roller during the printing of the print job, in which the developing roller is rotated at a predetermined rotational speed, becomes equal to or higher than a predetermined value by using a temperature detected by a temperature detector, and setting the rotational speed of the developing roller to the predetermined rotational speed at least at a start of the printing of the print job in a case where it is predicted that the temperature of the developer carried on the developing roller during the printing of the print job does not become equal to or higher than the predetermined value, and setting the rotational speed of the developing roller to a low speed lower than the predetermined rotational speed from the start to an end of the printing of the print job in a case where it is predicted that the temperature of the developer carried on the developing roller during the printing of the print job becomes equal to or higher than the predetermined value.

According to another aspect of the disclosure, there is provided a non-transitory computer-readable storage medium storing computer-readable instructions, the instructions, when executed by a control device configured to control a rotational speed of a developing roller configured to supply developer to a surface of a photosensitive member, causing the control device to perform: predicting, before printing a print job, whether or not a temperature of the developer carried on the developing roller during the printing of the print job, in which the developing roller is rotated at a predetermined rotational speed, becomes equal to or higher than a predetermined value by using a temperature detected by a temperature detector, and setting the rotational speed of the developing roller to the predetermined rotational speed at least at a start of the printing of the print job in a case where it is predicted that the temperature of the developer carried on the developing roller during the printing of the print job does not become equal to or higher than the predetermined value, and setting the rotational speed of the developing roller to a low speed lower than the predetermined rotational speed from the start to an end of the printing of the print job in a case where it is predicted that the temperature of the developer carried on the developing roller during the printing of the print job becomes equal to or higher than the predetermined value.

BRIEF DESCRIPTION OF DRAWINGS

FIG. 2 is a block diagram showing a control device or the like;

DETAILED DESCRIPTION

Hereinafter, a color printer 1 as an example of an image forming apparatus according to an exemplary embodiment will be described in detail with reference to the accompanying drawings. In the following, directions will be described based on directions relative to a user using the color printer 1. Specifically, in FIG. 1, a left side is referred to as "front," a right side is referred to as "rear," a near side is referred to as "right," and a far side is referred to as "left." Further, an upper-lower direction in FIG. 1 is referred to as "upper and lower."

Figure 1:
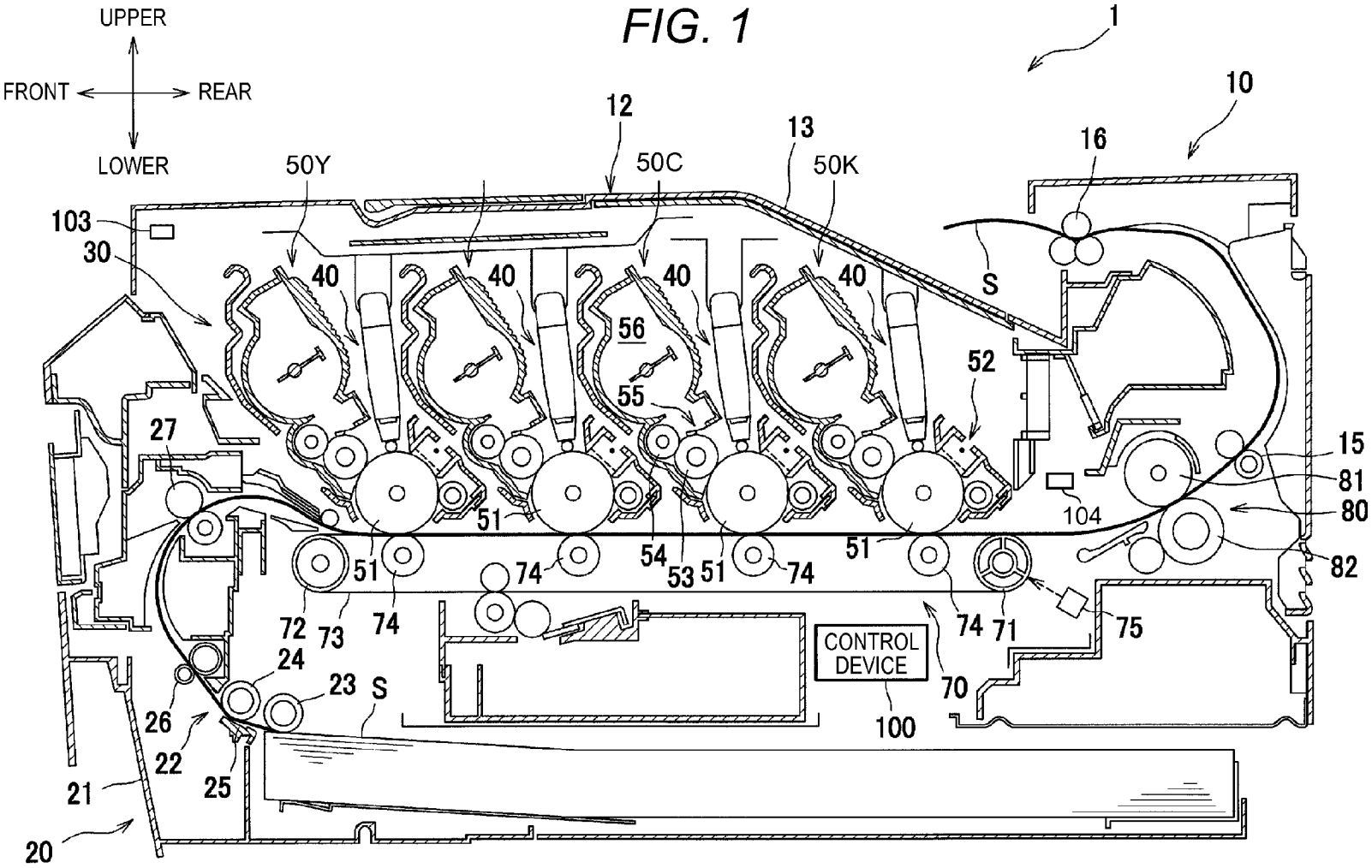
FIG. 1 is a view showing a schematic configuration of a color printer as an example of an image forming apparatus according to an exemplary embodiment.

As shown in FIG. 1, the color printer 1 mainly includes, in a housing 10, a sheet feeding part 20, an image forming part 30, and a control device 100. An upper cover 12 that opens and closes the top of the housing 10 is provided on an upper side of the housing 10. The upper cover 12 is pivotable up and down with a rear side serving as a pivot point. An outside temperature sensor 103 and an inside temperature sensor 104, which are examples of a temperature detector configured to detect temperature, are provided in the housing 10. The outside temperature sensor 103 is disposed near an air inlet and outputs a signal corresponding to the temperature of air flowing into the apparatus from the air inlet by the rotation of a fan. The inside temperature sensor 104 is disposed near a process unit 50K for forming a black toner image and outputs a signal corresponding to an inside temperature near the process unit 50K.

The sheet feeding part 20 is provided at a lower portion of the housing 10 and includes a sheet feeding tray 21 for accommodating sheets S as an example of a recording medium and a supply mechanism 22 for supplying the sheets S from the sheet feeding tray 21 to the image forming part 30. The supply mechanism 22 includes a pick-up roller 23, a separation roller 24, a separation pad 25, a sheet dust removing roller 26 and a registration roller 27.

In the sheet feeding part 20, the sheets S in the sheet feeding tray 21 are fed out by the pick-up roller 23, and then, are separated one by one between the separation roller 24 and the separation pad 25. Then, the sheet dust of the sheets S is removed by the sheet dust removing roller 26, a leading end position of the sheets S is restricted by the registration roller 27 in a state where the rotation is stopped, and then, the registration roller 27 is rotated to supply the sheets S to the image forming part 30.

In the present exemplary embodiment, the switching of the stop and rotation of the registration roller 27 is carried out at regular intervals, and hence, an interval (hereinafter, also referred to as "a sheet interval") of a plurality of sheets S to be conveyed is constant. Further, by changing the switching interval of the stop and rotation of the registration roller 27, the sheet interval is changed. Meanwhile, the disclosure is not limited thereto. For example, by changing the switching interval of the stop and rotation of the pick-up roller 23, the sheet interval may be changed.

The image forming part 30 includes four LED units 40 as an example of an exposure device, four process units 50, a transfer unit 70, and a fixation unit 80. The LED units 40 and the process units 50 are respectively provided so as to correspond to a color of a toner image to be formed, i.e., four colors of black (K), cyan (C), magenta (M) and yellow (Y).

The LED units 40 are arranged so as to face the top of photosensitive drums 51 as an example of a photosensitive member. Each LED unit 40 is provided at its lower end with a plurality of LEDs (Light Emitting Diodes) arranged in a lateral direction. The plurality of LEDs is not shown. A light emitting part of each LED unit 40 is blinking based on an image data, thereby exposing the surface of each photosensitive drum 51.

The process units 50 are provided between the upper cover 12 and the sheet feeding tray 21 and are arranged side by side in a longitudinal direction. The process units 50 are configured to be detachably mounted to the housing 10 in a state where the upper cover 12 is opened. Each of the process units 50 includes the photosensitive drum 51, a charger 52 for charging the photosensitive drum 51, a developing roller 53 for supplying toner as an example of developer to the photosensitive drum 51, a supply roller 54, a layer thickness regulating blade 55, and a toner container 56 for containing a positive charge type toner. The developing roller 53 is rotated by receiving a driving force from a motor for driving the developing roller 53. As at least one of the rotational speed change of the motor and the reduction ratio change of a transmission provided between the motor and the developing roller 53 is carried out, the developing roller 53 is rotated at a predetermined rotational speed v1 or rotated at a rotational speed v2 lower than the predetermined rotational speed v1. When the developing roller 53 is rotated at the rotational speed v1, the developing roller 53 is rotated at a speed 1.7 times faster than a rotational speed v3 of the photosensitive drum 51. When the developing roller 53 is rotated at the rotational speed v2, the developing roller 53 is rotated at a speed 1.2 times faster than the rotational speed v3 of the photosensitive drum 51. In a case where the developing roller 53 is rotated at the rotational speed v1, more toner can be made to face an electrostatic latent image formed on the photosensitive drum 51, as compared to a case where the developing roller 53 is rotated at the rotational speed v2. As a result, it is possible to form a stable high-quality toner image. Further, each of the developing rollers 53 is configured to be shifted between a position contacting with the photosensitive drum 51 and a position separated from the photosensitive drum 51, in accordance with the movement of a cam for displacing a position of the developing roller 53. In a case of forming only a black toner image, the printing can be carried out in the state where each developing roller 53 for forming cyan, magenta and yellow toner images is separated from the photosensitive drum 51 corresponding to each developing roller 53 and only the developing roller 53 for forming the black toner image is in contact with the photosensitive drum 51. At this time, the black toner image can be formed in a state where the rotation of the developing roller 53 corresponding to each of cyan, magenta and yellow is stopped and only the developing roller 53 corresponding to black is rotated.

The transfer unit 70 is provided between the sheet feeding tray 20 and the process units 50 and includes a driving roller 71, a driven roller 72, a conveyor belt 73 made of an endless belt, four transfer rollers 74, and a patch detection sensor 75 as an example of a detector. The conveyor belt 73 is stretched between the driving roller 71 and the driven roller 72. An outer surface of the conveyor belt 73 is disposed so as to face each photosensitive drum 51. Each transfer roller 74 is disposed at an inner side of the conveyor belt 73 so that the conveyor belt 73 is sandwiched between each photosensitive drum 51 and each transfer roller 74.

The patch detection sensor 75 is a sensor for detecting a concentration adjustment patch formed on the conveyor belt 73 and is disposed so as to face a rear portion of the conveyor belt 73. As such patch detection sensor 75, a light-reflection type sensor or the like, which includes a light emitting element and a light receiving element, can be employed, for example. In other words, in the patch detection sensor 75, the light emitting element irradiates light toward the conveyor belt 73 on which a toner image (i.e., patch) formed by toner supplied to a test electrostatic latent image formed on the photosensitive drum 51 is carried on, and the light receiving element detects the amount of reflected light from the conveyor belt 73 or the patch.

The fixation unit 80 is provided behind the process units 50 and the transfer unit 70 and includes a heating roller 81 and a pressing roller 82. The pressing roller 82 is disposed so as to face the heating roller 81 and presses the heating roller 81.

In the image forming part 30 thus configured, first, the surface of each photosensitive drum 51 is uniformly charged by the charger 52, and then, is exposed by LED light irradiated from each LED unit 40. In this way, a potential of the exposed portion is lowered and an electrostatic latent image based on the image data is formed on each photosensitive drum 51.

Further, the toner in the toner container 56 is supplied to the developing rollers 53 by the rotation of the supply rollers 54 and is introduced between the developing rollers 53 and the layer thickness regulating blades 55 by the rotation of the developing rollers 53. In this way, the toner is carried, as a thin layer having a constant thickness, on the developing rollers 53.

The toner carried on each developing roller 53 is supplied to the electrostatic latent image formed on each photosensitive drum 51 at a position where the developing roller 53 is in contact with the photosensitive drum 51. In this way, the toner is selectively carried on each photosensitive drum 51 and the electrostatic latent image becomes a visible image, and a toner image is formed by reversal development.

Next, the sheet S supplied on the conveyor belt 73 passes between each photosensitive drum 51 and each transfer roller 74, and hence, the toner image formed on each photosensitive drum 51 is transferred on the sheet S. Then, the sheet S passes between the heating roller 81 and the pressing roller 82, and hence, the toner image transferred on the sheet S is thermally fixed.

Further, the concentration of the patch is detected as follows. That is, a test electrostatic latent image is formed on the surface of the photosensitive drum 51, and then, the toner from the developing roller 53 is supplied to the test electrostatic latent image, so that a patch is formed on the photosensitive drum 51. The patch formed on the photosensitive drum 51 is transferred on the conveyor belt 73 by the transfer roller 74, and then, the concentration of the patch is detected by the patch detection sensor 75.

A conveying roller 15 is provided behind the fixation unit 80 and a discharge roller 16 is provided above the fixation unit 80. The sheet S discharged from the fixation unit 80 is discharged to the outside of the housing 10 by the conveying roller 15 and the discharge roller 16 and is accumulated in a sheet discharge tray 13.

Next, the control device 100 is described in detail.

Figure 2:
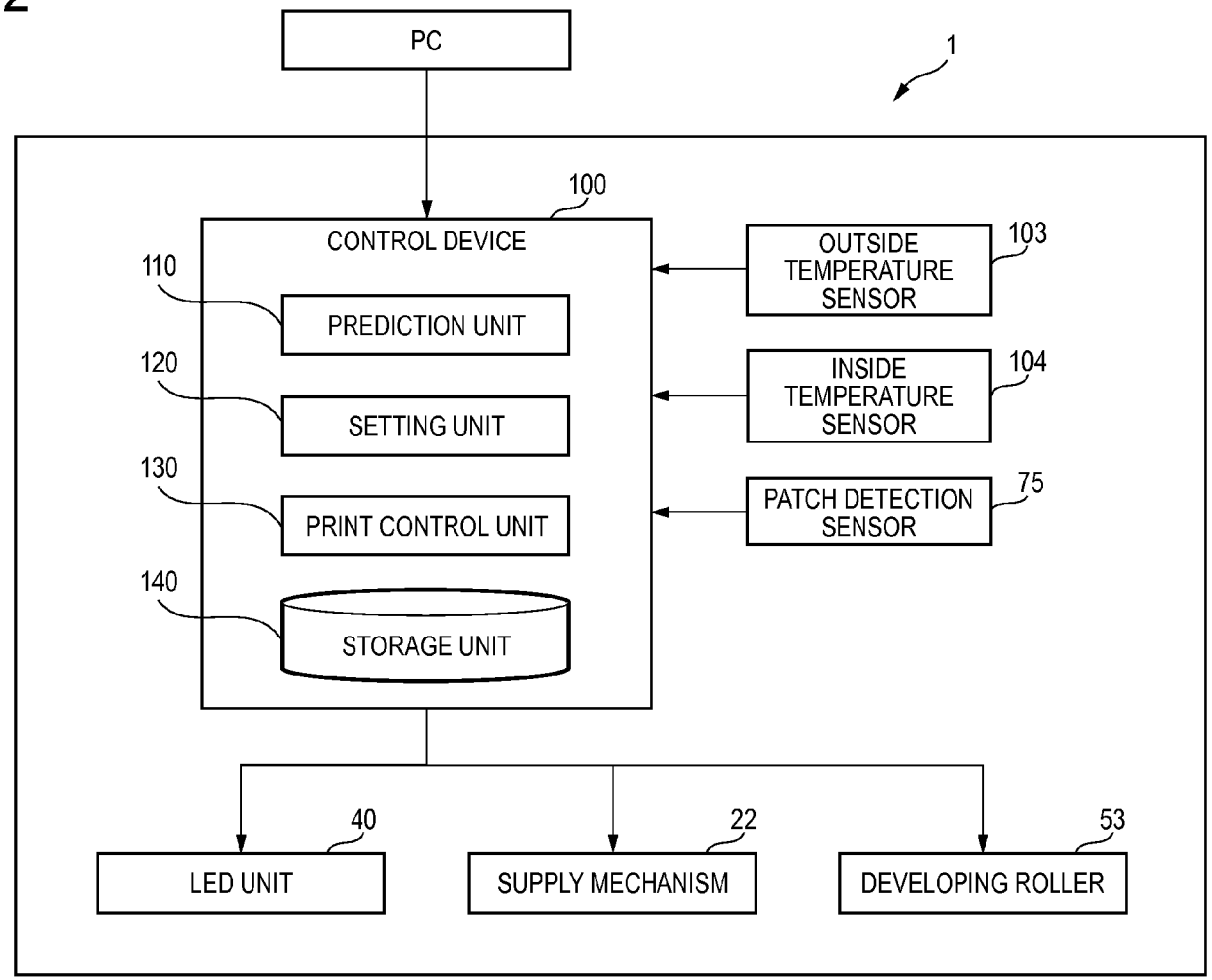

The control device 100 includes a CPU (Central Processing Unit), RAM (Random Access Memory), ROM (Read Only Memory), and an input/output circuit. The control device 100 executes a control by executing various operations based on a print job outputted from an external computer PC, information outputted from each of the sensors 103, 104, 75, and a program or data stored in the ROM or the like. Specifically, as shown in FIG. 2, the control device 100 includes a prediction unit 110, a setting unit 120, a print control unit 130, and a storage unit 140. In other words, the control device 100 operates based on the program stored in the storage unit 140 and serves as the prediction unit 110, the setting unit 120 and the print control unit 130.

Figure 7A:
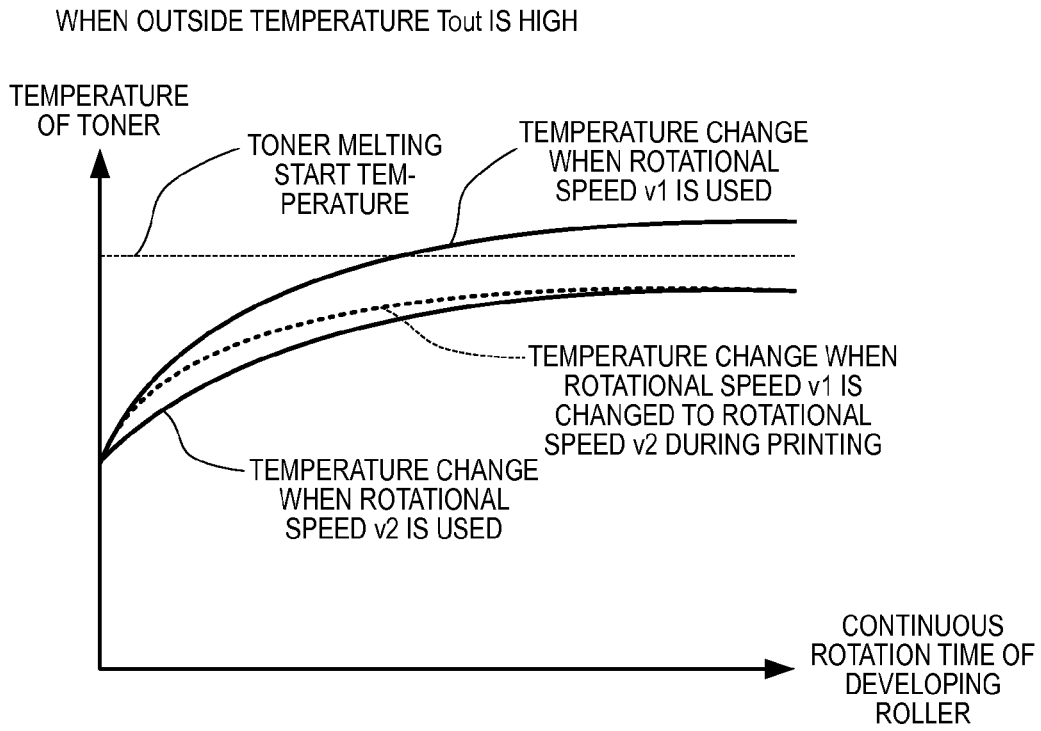
FIGS. 7A and 7B are graphs showing relationships between continuous rotation time of a developing roller and temperature of toner.
Figure 7B:
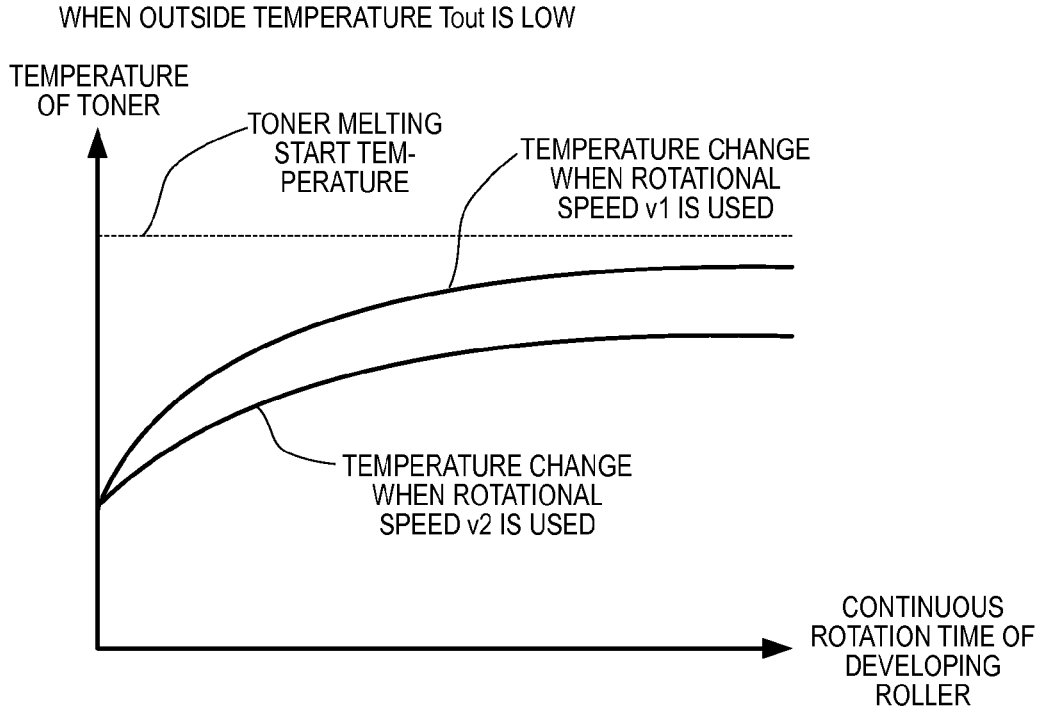

Before starting a printing based on a print job by the print control unit 130, the prediction unit 110 has a function of predicting whether or not the temperature of the toner carried on the developing roller 53 during the printing of the print job, in which the rotational speed v1 is used as the rotational speed v of the developing roller 53, becomes equal to or higher than a melting start temperature (e.g., 45° C.) at which the melting of the toner is started. A main factor of increasing the temperature of the toner carried on the developing roller 53 includes an ambient temperature of the place where the color printer 1 is installed and a frictional heat generated between the developing roller 53 and the layer thickness regulating blade 55. In a case where the ambient temperature of the place where the color printer 1 is installed is high, since the cooling effect by the air flowing into the apparatus is low, it is difficult to sufficiently cool the temperature of the toner carried on the developing roller 53 even if a fan is rotated. Further, the frictional heat generated between the developing roller 53 and the layer thickness regulating blade 55 is a heat generated at the surface of the developing roller 53, and the frictional heat is liable to cause an increase in the temperature of the toner carried on the developing roller 53. Therefore, especially when the developing roller 53 is rotated at the rotational speed v1 for a long time in a state where the ambient temperature of the place where the color printer 1 is installed is high, the possibility that the temperature of the toner carried on the developing roller 53 becomes equal to or higher than the melting start temperature becomes high. FIGS. 7A and 7B show relationships between a continuous rotation time of the developing roller 53 and the temperature of the toner. Specifically, FIG. 7A shows a temperature change of the toner when the temperature Tout acquired from the outside temperature sensor 103 is high, and FIG. 7B shows a temperature change of the toner when the temperature Tout acquired from the outside temperature sensor 103 is low. When the temperature Tout acquired from the outside temperature sensor 103 is low, sufficient cooling effect can be obtained from the air flowing into the apparatus. Therefore, as shown in FIG. 7B, not only when the rotational speed v2 is used as the rotational sped of the developing roller 53 but also when the rotational speed v1 is used as the rotational speed of the developing roller 53, the temperature of the toner changes while not becoming equal to or higher than the melting start temperature of the toner at which the melting of the toner is started even when the developing roller 53 is rotated for a long time. Meanwhile, when the temperature Tout acquired from the outside temperature sensor 103 is high, the cooling effect by the air flowing into the apparatus is low. Therefore, as shown in FIG. 7A, the temperature of the toner may become higher than the melting start temperature of the toner at which the melting of the toner is started when the developing roller 53 is rotated for a long time by the rotational speed v1. When the melting of the toner occurs, problems such as degradation in the image quality are concerned. For this reason, as shown by a chained line in FIG. 7A, there is a need to suppress the generation of the above-described frictional heat by lowering the rotational speed of the developing roller 53 from the rotational speed v1 to the rotational speed v2, or to wait until the temperature of the toner carried on the developing roller 53 is lowered by temporarily stopping the printing operation. Meanwhile, in the color printer 1 of the present exemplary embodiment, each developing roller 53 is placed on the upstream side of airflow generated by the rotation of the fan and the fixation unit 80 is placed on the downstream side of the developing roller 53. Therefore, the heat from the fixation unit 80 does not have a significant effect on the temperature of the toner carried on the developing roller 53. Here, as a method of predicting whether or not the temperature of the toner carried on the developing roller 53 during the printing of the print job is equal to or higher than the melting start temperature when the developing roller 53 is rotated at the rotational speed v1 to print the print job, the following method is employed. Specifically, for example, during the period from the receipt of the print job to the start of the printing of the print job, the prediction unit 110 acquires a temperature Tout from the outside temperature sensor 103 and determines whether or not the temperature Tout before the start of the printing of the print job is equal to or higher than a first threshold T1. In this way, the prediction unit predicts whether or not the temperature of the toner carried on the developing roller 53 during the printing of the print job, in which the developing roller 53 is rotated at the rotational speed v1, is equal to or higher than the melting start temperature. That is, in a case where the temperature Tout acquired from the outside temperature sensor 103 is equal to or higher than the first threshold T1, the ambient temperature of the place where the color printer 1 is installed is high. When, under such situation, the developing roller 53 is rotated at the rotational speed v1 to print the print job, it is difficult to sufficiently lower the temperature of the toner carried on the developing roller 53. Accordingly, there is a possibility that the temperature of the toner carried on the developing roller 53 during the printing of the print job reaches the melting start temperature or becomes higher.

Here, the first threshold T1 may be properly set based on the results of experiments or simulations or the like. Meanwhile, the prediction and determination is not limited to the method as described in the present exemplary embodiment. For example, the determination may be made by using the temperature Tout acquired from the outside temperature sensor 103 during the period from the receipt of the print job to the start of the printing of the print job and the number of printing sheets indicated in the print job. Specifically, for example, in a case where the temperature Tout acquired from the outside temperature sensor 103 is equal to or higher than the first threshold T1 and the number of printing sheets indicated in the print job is equal to or higher than a predetermined number, the temperature of the toner carried on the developing roller 53 during the printing of the print job, in which the developing roller 53 is rotated at the rotational speed v1, may be predicted to be equal to or higher than the melting start temperature. That is, in a case where the temperature Tout detected by the outside temperature sensor 103 is equal to or higher than the first threshold T1, the ambient temperature of the place where the color printer 1 is installed is high. When a predetermined number or more of printings are performed under such situation, the effect of the frictional heat between the developing roller 53 and the layer thickness regulating blade 55 is also applied. Therefore, it is difficult to sufficiently lower the temperature of the toner carried on the developing roller 53. Accordingly, there is a possibility that the temperature of the toner carried on the developing roller 53 during the printing of the print job reaches the melting start temperature or becomes higher. Here, in addition to the acquirement of the temporary temperature Tout from the outside temperature sensor 103, the temperature Tout may be acquired a plurality of times. By doing so, it can be determined whether or not the rise of the temperature Tout for a predetermined time before starting the printing of the print job is equal to or higher than a certain amount. Accordingly, by taking into consideration whether or not the ambient temperature of the place where the color printer 1 is installed tends to increase, it is possible to predict whether or not the temperature of the toner carried on the developing roller 53 during the printing of the print job, in which the developing roller 53 is rotated at the rotational speed v1, reaches the melting start temperature or becomes higher. Further, the temperature Tout acquired from the outside temperature sensor 103 is affected by the temperature inside the apparatus immediately after the printing operation is executed, and thus, becomes higher than the ambient temperature of the place where the color printer 1 is installed. Accordingly, a temperature Tin outputted from the inside temperature sensor 104 during the period from the receipt of the print job to the start of the printing of the print job may be acquired, and the temperature Tout acquired from the outside temperature sensor 103 may be corrected to a lower value in a case where the temperature Tin acquired from the inside temperature sensor 104 is high. Then, it may be predicted whether or not the temperature of the toner carried on the developing roller 53 during the printing of the print job reaches the melting start temperature or becomes higher. Further, in a monochrome printing where the developing roller 53 corresponding to each of cyan, magenta and yellow stops rotating by being separated from each photosensitive drum 51 and only the developing roller 53 corresponding to black is rotated by being in contact with the photosensitive drum 51, the total amount of frictional heat generated between the developing roller 53 and the layer thickness regulating blades 55 is small, as compared to a color printing where the developing roller 53 of each color is rotated by being in contact with the photosensitive drum 51. Therefore, in the monochrome printing, the possibility that the temperature of the toner carried on the developing roller 53 becomes equal to or higher than the melting start temperature is lowered. For this reason, after considering whether the print job is the monochrome printing or the color printing, it may be predicted whether or not the temperature of the toner carried on the developing roller 53 during the printing of the print job, in which the developing roller 53 is rotated at the rotational speed v1, reaches the melting start temperature or higher. Specifically, in a case where the print job is the monochrome printing, it may be predicted that the temperature of the toner carried on the developing roller 53 during the printing of the print job, in which the developing roller 53 is rotated at the rotational speed v1, is lower than the melting start temperature.

In a case where the prediction unit 110 predicts that the temperature of the toner carried on the developing roller 53 during the printing of the print job does not increase to the melting start temperature even when the developing roller 53 is rotated at the rotational speed v1 to print the print job, the setting unit 120 has a function of setting the rotational speed v of the developing roller 53 to the predetermined rotational speed v1 and setting a developing bias Vd applied to the developing roller 53 to a first setting value Vd1 suitable for the rotational speed v1. Further, in a case where the prediction unit 110 predicts that the temperature of the toner carried on the developing roller 53 during the printing of the print job increases to the melting start temperature or higher when the developing roller 53 is rotated at the rotational speed v1 to print the print job, the setting unit 120 has a function of setting the rotational speed v of the developing roller 53 to a lower speed v2 lower than the predetermined rotational speed v1 and setting the developing bias Vd to a second setting value Vd2 suitable for the low speed v2. When the developing roller 53 is rotated at the rotational speed v2 to print the print job, it is possible to reduce the generation of frictional heat between the developing roller 53 and the layer thickness regulating blade 55. The frictional heat is liable to cause the rise of the temperature of the toner carried on the developing roller 53. As a result, it is possible to suppress the temperature of the toner carried on the developing roller 53 from being equal to or higher than the melting start temperature.

The setting of other parameters by the setting unit 120, for example, the charging bias, the exposure amount, or the like, may be suitably made based on setting values stored in the storage unit 140 and conditions such as temperature. In a case where it is intended to add humidity as the conditions, a humidity sensor may be suitably provided. Further, in the present exemplary embodiment, in both cases where the prediction unit 110 predicts that the temperature of the toner carried on the developing roller 53 during the printing of the print job does not increase to the melting start temperature even when the developing roller 53 is rotated at the rotational speed v1 to print the print job and where the prediction unit 110 predicts that the temperature of the toner carried on the developing roller 53 during the printing of the print job increases to the melting start temperature or higher when the developing roller 53 is rotated at the rotational speed v1 to print the print job, the rotational speed of the photosensitive drum 51 and the rotational speed of the driving roller 71 of the transfer unit 70 are set to the same value, and thus, the conveying speed of the paper S is the same.

The print control unit 130 has a function of executing a print control based on the setting values which are set in the setting unit 120. Especially, in a case where the prediction unit 110 predicts that the temperature of the toner carried on the developing roller 53 during the printing of the print job does not increase to the melting start temperature even when the developing roller 53 is rotated at the rotational speed v1 to print the print job, the print control unit 130 executes the print control in a first print mode. Further, in a case where the prediction unit 110 predicts that the temperature of the toner carried on the developing roller 53 during the printing of the print job increases to the melting start temperature or higher, the print control unit 130 executes the print control in a second print mode. Here, the print control refers to controlling the image forming part 30 or the sheet feeding part 20 or the like in accordance with the print job.

The print control unit 130 determines whether or not a first condition is satisfied and determines whether or not a second condition is satisfied. The first condition refers to that, in the first print mode, the temperature of the toner carried on the developing roller 53 during the printing of the print job becomes equal to or higher than the melting start temperature, contrary to the prediction. The second condition refers to that the effect of the switching of the rotational speed v of the developing roller 53 on the image quality is small. Specifically, as a method for determining whether or not the first condition is satisfied, the print control unit 130 acquires the temperature Tin from the inside temperature sensor 104 during the printing of the print job and determines whether or not the temperature Tin is equal to or higher than a threshold Tth (e.g., 50° C.). In this way, the print control unit 130 determines whether or not the temperature of the toner carried on the developing roller 53 during the printing of the print job is equal to or higher than the melting start temperature, contrary to the prediction. More specifically, the print control unit 130 determines that the temperature of the toner carried on the developing roller 53 is equal to or higher than the melting start temperature (e.g., 45° C.) in a case where the temperature Tin acquired from the inside temperature sensor 104 is equal to or higher than the threshold Tth. When determining whether or not the first condition that, contrary to the prediction, the temperature of the toner carried on the developing roller 53 during the printing of the print job is equal to or higher than the melting start temperature is satisfied, not the temperature Tout acquired from the outside temperature sensor 103 but the temperature Tin acquired from the inside temperature sensor 104 is used. The reason is that the temperature Tin outputted from the inside temperature sensor 104 rather than the temperature Tout outputted from outside temperature sensor 103 has a strong correlation with the temperature of the toner carried on the developing roller 53, and thus, it is possible to more accurately determine whether or not the temperature of the toner carried on the developing roller 53 is equal to or higher than the melting start temperature. Further, as a method of determining whether or not the second condition is satisfied, the print control unit 130 determines whether or not the contents of the print job correspond to at least one of a monochrome print using only a black toner image, a text document print adapted to print only texts that do not include photos and graphics, and a low image quality print in which a print image quality specified by a user is lower than a predetermined quality. The print control unit 130 determines that the effect on the image quality is small in a case where the contents of the print job correspond to at least one of the monochrome print, the text document print and the low image quality print.

Further, the print control unit 130 is configured to switch the rotational speed v of the developing roller 53 during the printing of the print job from the predetermined rotational speed v1 to the low speed v2 in a case where both the first condition and the second condition are satisfied in the first print mode. More specifically, the print control unit 130 is configured to execute the switching of the rotational speed v in response to determining that both the first condition and the second condition are satisfied, i.e., at the time of determination. Meanwhile, the disclosure is not limited thereto. For example, the switching of the rotational speed v may be executed after a predetermined time from the time of determination.

Further, the print control unit 130 is configured to temporarily stop the printing of the print job and to determine whether or not the temperature Tin acquired from the inside temperature sensor 104 is lower than the second threshold T2 lower than the threshold Tth in a case where it is determined that, in the first print mode, the first condition is satisfied and the second condition is not satisfied, and to resume the printing of the print job in a case where the temperature Tin acquired from the inside temperature sensor 104 becomes lower than the second threshold T2.

Further, in the second print mode, first, the print control unit 130 is configured to execute a patch test before starting the printing of the print job. Specifically, the print control unit 130 executes the patch test by driving the developing rollers 53, the photosensitive drums 51, the LED units 40 and the like by the setting values set by the setting unit 120 before starting the printing of the print job. At this time, the rotational speed v of the developing rollers 53 is the low speed v2 and the developing bias Vd is the second setting value Vd2.

In the patch test, the print control unit 130 forms a test surface of each photosensitive drum 51 and supplies toner from each developing roller 53 to the electrostatic latent image, thereby forming a patch on each photosensitive drum 51. Then, the print control unit 130 transfers each patch on each photosensitive drum 51 to the conveyor belt 73 and detects the concentration of each patch on the conveyor belt 73 by the patch detection sensor 75. Then, the print control unit 130 executes the concentration adjustment based on the detection results of the patch detection sensor 75, and then, starts the printing of the print job.

Specifically, the print control unit 130 executes, as the concentration adjustment, a developing bias correction and a gamma correction. The developing bias correction is a process for acquiring a correction value to adjust a deviation between the ideal concentration specified by the color printer 1 and the concentration of the patch that is actually formed. In the developing bias correction, the color printer 1 forms a patch of predetermined concentration (e.g., 100%) for each color. These patches are read by the patch detection sensor 75, the actual concentration of the patches is calculated based on the amount of received light, and the developing bias Vd is adjusted so as to allow the concentration to be closer to the ideal concentration.

The gamma correction is a process for adjusting a deviation between the indication concentration (indication gradation) by the external computer PC and the output concentration of the color printer 1 itself. In the gamma correction, the color printer 1 forms a plurality of patches of different concentration at predetermined concentration intervals (e.g., 20%, 40%, 60%, 80% and 100%) for each color. These patches are read by the patch detection sensor 75, the actual concentration of the patches is calculated based on the amount of received light, and the variation characteristics of concentration of each color are specified from the relative relationship of concentration among the patches. Then, a relative relationship table between the variation characteristics and the indication gradations of the external computer PC is created.

As described above, the concentration adjustment includes the developing bias correction and the gamma correction. Among these, the developing bias correction uniformly adjusts the shortage and excess of concentration over all gradations. On the other hand, the gamma correction is an adjustment for solving the shortage and excess of concentration for each gradation by substituting the gradation instructed from the external computer PC with another gradation based on the relative relationship table.

The storage unit 140 stores various setting values such as the predetermined rotational speed v1, the low speed v2, the first setting value Vd1 and the second setting value Vd2, or a program for operating the prediction unit 110, the setting unit 120 and the print control unit 130, or the like.

Next, an operation of the control device 100 is described in detail.

Figure 3:
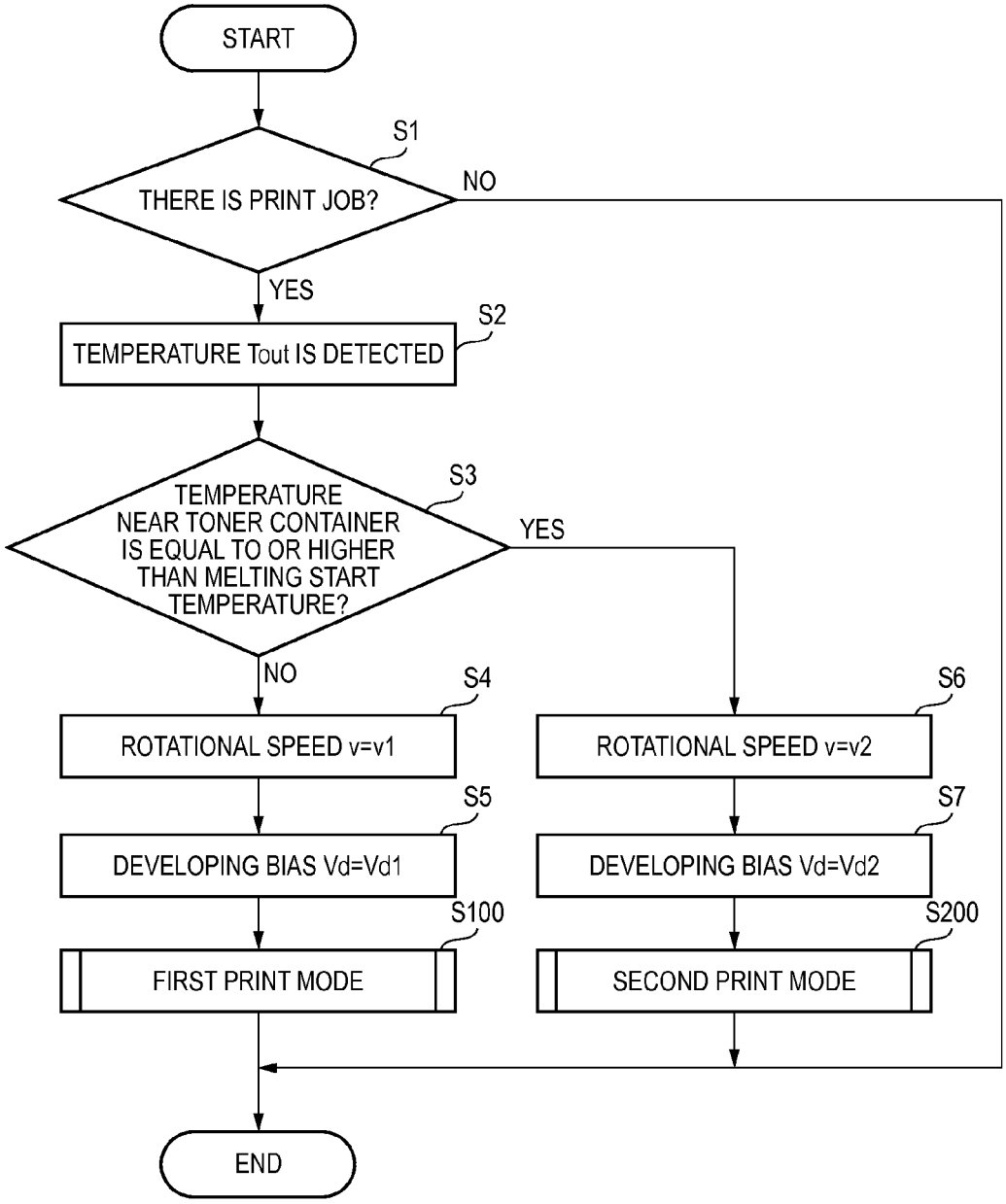
FIG. 3 is a flow chart showing an operation of the control device.

As shown in FIG. 3, first, the control device 100 determines whether or not a print job is received from the external computer PC, thereby determining whether or not there is a print job (S1). The control device 100 ends the control in a case where it is determined in Step S1 that there is no print job (No), and acquires the temperature Tout from the outside temperature sensor 103 in a case where it is determined in Step S1 that there is a print job (Yes) (S2). That is, in Step S2, the control device 100 acquires the temperature Tout before the printing of the print job.

After Step S2, the control device 100 determines whether or not the temperature of the toner carried on the developing roller 53 during the printing of the print job, in which the developing roller 53 is rotated at the rotational speed v1, becomes equal to or higher than the melting start temperature based on the prediction result of the above-described prediction unit 110 (S3). In a case where it is determined in Step S3 that the temperature of the toner carried on the developing roller 53 during the printing of the print job, in which the developing roller 53 is rotated at the rotational speed v1, does not become equal to or higher than the melting start temperature (No), the control device 100 sets the rotational speed v of the developing roller 53 to the predetermined rotational speed v1 (S4) and sets the developing bias Vd to the first setting value Vd1 (S5). After Step S5, the control device 100 proceeds to a first print mode (S100).

On the other hand, in a case where it is determined in Step S3 that the temperature of the toner carried on the developing roller 53 during the printing of the print job, in which the developing roller 53 is rotated at the rotational speed v1, becomes equal to or higher than the melting start temperature based on the prediction results of the above-described prediction unit 110 (Yes), the control device 100 sets the rotational speed v of the developing roller 53 to the low speed v2 (S6) and sets the developing bias Vd to the second setting value Vd2 (S7). After Step S7, the control device 100 proceeds to a second print mode (S200).

Figure 4:
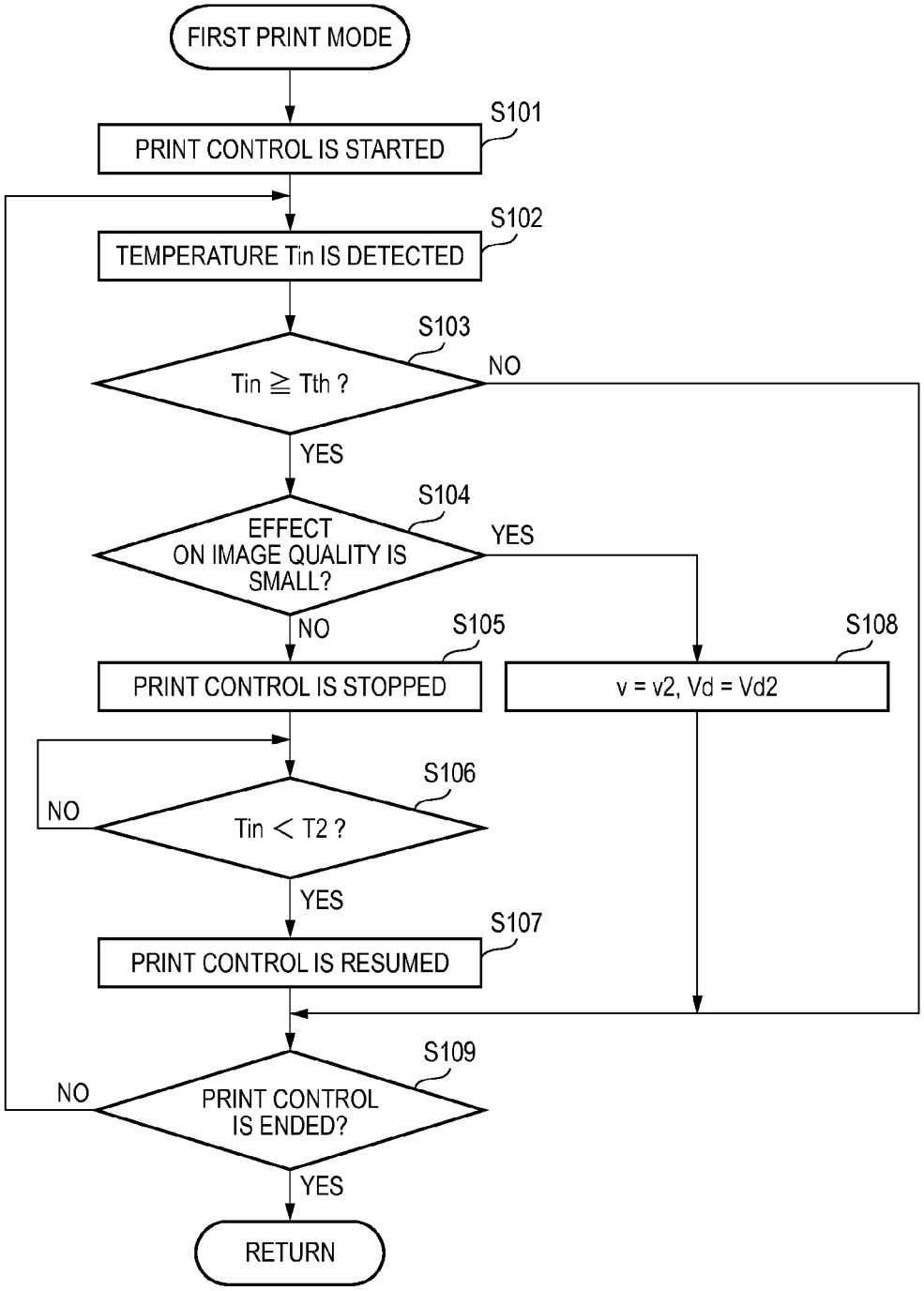
FIG. 4 is a flow chart showing a first print mode.

As shown in FIG. 4, in the first print mode, the control device 100 first sets setting values other than the setting values (v1, Vd1) set in Steps S4, S5, for example, the charging bias, the exposure amount or the like by the above-described method or the like, and then, starts the print control, i.e., the printing of the print job based on the various setting values which are set (S101). After Step S101, the control device 100 acquires the temperature Tin from the inside temperature sensor 104 (S102). Specifically, in Step S102, the control device 100 acquires the temperature Tin inside the apparatus near the process unit 50K during the printing of the print job.

After Step S102, the control device 100 determines whether or not the temperature Tin becomes equal to or higher than the threshold Tth (S103). When it is determined in Step S103 that the temperature Tin becomes equal to or higher than the threshold Tth (Yes), the control device 100 determines whether or not the print mode is a mode that the effect of the contents of the print job on the image quality is small, i.e., determines whether or not the print mode corresponds to at least one of the monochrome print, the text document print and the low image quality print (S104).

In a case where it is determined in Step S104 that the effect of the contents of the print job on the image quality is large (No), the control device 100 temporarily stops the print control (S105). After Step S105, the control device 100 determines whether or not the temperature Tin becomes lower than the second threshold T2 (S106). In a case where it is determined in Step S106 that the temperature Tin becomes lower than the second threshold T2 (Yes), the control device 100 resumes the print control based on various setting values immediately before the stop of the print control (S107). On the other hand, in a case where it is determined in Step S106 that the temperature Tin is equal to or higher than the second threshold T2 (No), the control device 100 repeats the processing of Step S106.

In a case where it is determined in Step S104 that the effect of the contents of the print job on the image quality is small (Yes), the control device 100 immediately switches the rotational speed v of the developing roller 53 from the predetermined rotational speed v1 to the low speed v2 and switches the developing bias Vd into the second setting value Vd2 (S108). In this way, the developing roller 53 is rotated at the low speed v2, and thus, the frictional heat between the developing roller 53 and the layer thickness regulating blade 55 is reduced. As a result, the temperature of the toner carried on the developing roller 53 is suppressed from being equal to or higher than the melting start temperature, so that the melting of the toner in the high-temperature environment is suppressed.

After Steps S107, S108, the control device 100 determines whether or not the print control is ended, i.e., determines whether or not all of the number of printing sheets specified in the print job is printed (S109). In a case where it is determined in Step S109 that the print control is not ended (No), the control device 100 returns to the processing of Steps S102. On the other hand, in a case where it is determined in Step S109 that the print control is ended (Yes), the control device 100 ends the control.

Figure 5:
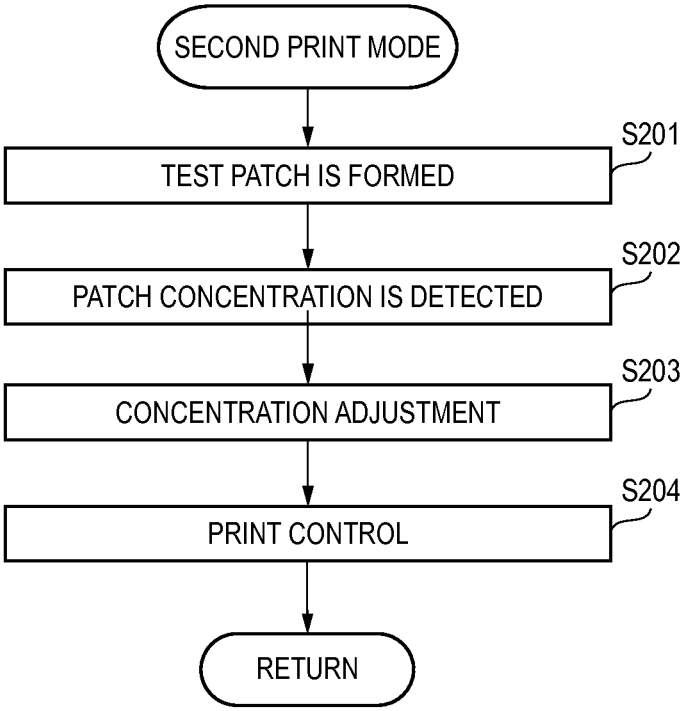
FIG. 5 is a flow chart showing a second print mode.

As shown in FIG. 5, in the second print mode, the control device 100 first sets setting values other than the setting values (v2, Vd2) set in Steps S6, S7, for example, the charging bias, the exposure amount or the like by the above-described method or the like, and then, forms a test patch based on the various setting values which are set (S201). After Step S201, the control device 100 acquires the concentration of the patch from the patch detection sensor 75 (S202) and executes the concentration adjustment based on this concentration (S203). Specifically, in Step S203, the control device 100 executes the developing bias correction and the gamma correction.

After Step S203, the control device 100 executes the print control based on the adjusted developing bias Vd2 and the various setting values set (S204), and then, ends the control. Here, in Step S204, the print control, i.e., the printing of the print job is executed from the start to the end without changing the various setting values. In this way, the developing roller 53 is rotated at the low speed v2 from the start to the end of the printing of the print job, and thus, the rotational speed of the developing roller 53 is not changed during the printing of the print job. Therefore, it is possible to suppress the melting of the toner in the high-temperature environment while avoiding a defect that there occurs a difference in the image quality of the print job between a print result before the rotational speed of the developing roller 53 in the printing of the print job is reduced and a print result after the rotational speed of the developing roller 53 is reduced, and hence, the unity in the image quality of the print job is lost.

According to the above description, the following effects can be obtained.

Since the developing roller 53 is rotated at the low speed v2, i.e., at a constant speed from the start to the end of the printing of the print job in a case where, before the printing of the print job, the temperature of the toner carried on the developing roller 53 during the printing of the print job is predicted to be equal to or higher than the melting start temperature, it is possible to improve the unity in the image quality of the print job, as compared to a known control where the rotational speed v of the developing roller 53 is switched during the printing of the print job.

In a case where the rotational speed v of the developing roller 53 is changed, the developing bias Vd is set to a value suitable for the changed rotational speed v. As a result, it is possible to improve the image quality.

In a case where printing is performed by rotating the developing roller 53 at the low speed v2 from the start to the end of the printing of the print job, the developing bias Vd2 is based on the concentration of the patch before starting the printing of the print job. Therefore, it is possible to improve the image quality in a case where the developing roller 53 is rotated at a low speed.

In a case where, contrary to the prediction before the printing of the print job, the temperature Tin acquired from the inside temperature sensor 104 during the printing of the print job becomes equal to or higher than the threshold Tth, the rotational speed v of the developing roller 53 is switched to the low speed v2. Therefore, the melting of the toner in the high-temperature environment can be suppressed even in a case where the prediction is incorrect. Here, such cases where the prediction is incorrect include, for example, a case where new print job is outputted during the printing of the print job and two print jobs are processed together as a single print job, and a case where a heating appliance is actuated at the place where the color printer 1 is installed, and thus, the room temperature rises.

Since the rotational speed v is switched to the low speed v2 in a case where the effect of the switching of the rotational speed v of the developing roller 53 on the image quality during the printing of the print job is small, the melting of the toner can be suppressed and the degradation in the image quality due to the switching of the rotational speed v can also be suppressed.

Since the rotational speed v of the developing roller 53 is switched to the low speed v2 in response to determining that the first condition and the second condition are satisfied, i.e., at the time of determination, the timing of switching the rotational speed of the developing roller 53 to the low speed can be quickened, for example, as compared to a method of switching the rotational speed v after a predetermined time from the time of determination. As a result, the melting of the toner can be suppressed accordingly.

In a case where the temperature Tin acquired from the inside temperature sensor 104 during the printing of the print job is equal to or higher than the threshold Tth, but the effect of the switching of the rotational speed v of the developing roller 53 on the image quality is large, for example, in a case of a high image quality print, etc., the printing of the print job is temporarily stopped. Therefore, the degradation in the image quality due to the switching of the rotational speed v can be suppressed and the melting of the toner in the high-temperature environment can be also suppressed. Further, in a case where the temperature Tin acquired from the inside temperature sensor 104 becomes lower than the second threshold T2 lower than the threshold Tth after the printing of the print job is stopped, i.e., in a case where it is escaped from the high-temperature environment, the printing of the print job is resumed. Therefore, the print control can be favorably executed without melting the toner.

Meanwhile, the disclosure is not limited to the above exemplary embodiment but can be used in various forms as illustrated below. In the following description, substantially the same configuration or processing as the above exemplary embodiment is denoted by the same reference numerals and a description thereof is omitted.

In the above exemplary embodiment, the print control is temporarily stopped (S105) in a case where the first condition is satisfied (S103: Yes) and the second condition is not satisfied (S104: No). However, the disclosure is not limited thereto. For example, in a case where the first condition is satisfied and the second condition is not satisfied, the control device 100 may be configured to switch the rotational speed v of the developing roller 53 from the predetermined rotational speed v1 to the low speed v2 during a time period from when a transfer of a toner image corresponding to the preceding sheet S on the photosensitive drum 51 is completed till when a exposure by the LED unit 40 corresponding to the succeeding sheet S is started. In this case, the conveying mechanism for conveying the sheet S may be controlled such that the time period from when the transfer of the toner image corresponding to the preceding sheet S on the photosensitive drum 51 is completed till when the exposure by the LED unit 40 corresponding to the succeeding sheet S is started is longer than the time period before the determination us performed. Here, in the following description, the time period from when the transfer of the toner image corresponding to the preceding sheet S on the photosensitive drum 51 is completed till when the exposure by the LED unit 40 corresponding to the succeeding sheet S is started may be referred to as "post-transfer pre-exposure time".

Figure 6:
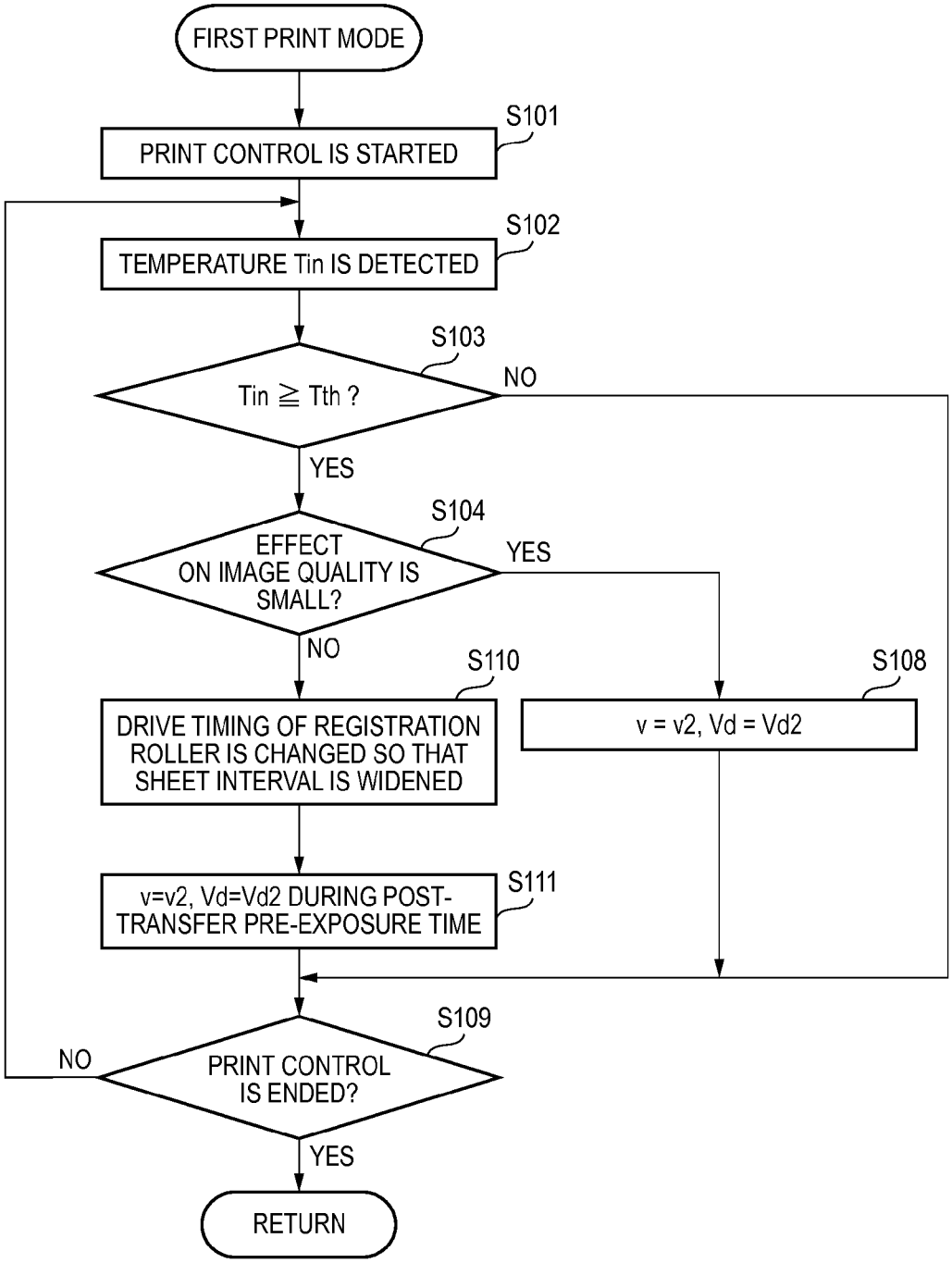
FIG. 6 is a flow chart showing a modified example of the first print mode.

Specifically, as shown in FIG. 6, instead of the processing of Steps S105 to S107 in the above exemplary embodiment, the processing of new Steps S110, S111 may be added. Meanwhile, in the example shown in FIG. 6, the registration roller 27 is illustrated as an example of a conveying mechanism. However, the disclosure is not limited thereto. The pick-up roller 23 or the like may also be used as a conveying mechanism.

As shown in FIG. 6, the control device 100 proceeds to the processing of Step S110 in a case where it is determined "No" in Step S104. In Step S110, the control device 100 changes the drive timing (the timing for starting the driving of the registration roller 27 in a stopped state) of the registration roller 27 so that the sheet interval is widened. Specifically, the control device 100 sets the drive timing of the registration roller 27 to the first time from the previous drive start before it is determined "No" in Step S104, and sets the drive timing of the registration roller 27 to the second time longer than the first time from the previous drive start after it is determined "No" in S104. More specifically, the control device 100 sets a drive start interval from the drive start to the next drive start of the registration roller 27 to the first time before it is determined "No" in Step S104, and switches the drive start interval into the second time longer than the first time after it is determined "No" in Step S104. By delaying the drive timing of the registration roller 27 after the determination than the drive timing before the determination in this way, the sheet interval can be widened.

The exposure start timing of each LED unit 40 is set to the time respectively set for each color after the drive start of the registration roller 27. Therefore, the post-transfer pre-exposure time becomes a predetermined third time when the drive start interval is set to the first time, and the post-transfer pre-exposure time becomes a fourth time longer than the third time when the drive start interval is set to the second time. That is, as described above, by delaying the drive timing of the registration roller 27 after the determination than the drive timing before the determination, the post-transfer pre-exposure time can be made longer than the time before the determination.

After Step S110, during the post-transfer pre-exposure time which is increased from the third time to the fourth time by the change of the drive timing of the registration roller 27, the control device 100 switches the rotational speed v of the developing roller 53 to the low speed v2 and switches the developing bias Vd into the second setting value Vd2 (S111). Specifically, since the transfer to the photosensitive drum 51 on the most upstream side in the conveying direction of the sheet S, the transfer to the second photosensitive drum 51 from the most upstream side, the transfer to the third photosensitive drum 51 from the most upstream side, and the transfer to the photosensitive drum 51 on the most downstream side are subsequently completed, the control device 100 switches the rotational speed v and the developing bias Vd subsequently from the developing roller 53 on the most upstream side every time the transfer in each photosensitive drum 51 is completed.

By switching the rotational speed v and the developing bias Vd of the developing roller 53 during each post-transfer pre-exposure time in this way, the rotational speed v and the developing bias Vd of the developing roller 53 can be switched while the transfer of the toner image or the exposure of the photosensitive drum 51 are not executed. Therefore, the transfer failure or the exposure failure due to the effect of the switching of the rotational speed v or the like can be suppressed, so that the degradation in the image quality can be suppressed.

Further, since the drive timing of the registration roller 27 is delayed in a case where it is determined "No" in Step S104, each post-transfer pre-exposure time becomes a fourth time longer than the time before the time of determination. Therefore, it is possible to secure the time for switching the rotational speed v or the like. As a result, the degradation in the image quality can be more favorably suppressed.

In the above exemplary embodiment, the rotational speed v of the developing roller 53 is switched to the low speed v2 in a case where, contrary to the prediction before the printing of the print job, the temperature Tin acquired from the inside temperature sensor 104 during the printing of the print job becomes equal to or higher than the threshold Tth. However, the disclosure is not limited thereto. For example, in a case where it is determined in the prediction before the printing of the print job that the temperature of the toner carried on the developing roller 53 does not increase to the melting start temperature, the developing roller 53 may be rotated at the predetermined rotational speed v1 from the start to the end of the printing of the print job.

In the above exemplary embodiment, as the conditions for switching the rotational speed v of the developing roller 53 from the predetermined rotational speed v1 to the low speed v2 during the printing of the print job, two conditions of the first condition and the second condition are used. However, the disclosure is not limited thereto. For example, only the first condition may be used, or, three or more conditions may be used.

In the above exemplary embodiment, as an example of a parameter that affects the supply amount of the toner from the developing roller 53 to the photosensitive drum 51, the developing bias Vd is illustrated. However, the disclosure is not limited thereto. For example, the charging bias or the exposure amount or the like may be used.

In the above exemplary embodiment, a positive charge type toner is illustrated as the developer. However, the disclosure is not limited thereto. A negative charge type toner may be used. In this case, the developing bias or the charging bias or the like may be appropriately set correspondingly with the negatively chargeable toner.

In the above exemplary embodiment, the disclosure is applied to the color printer 1. However, the disclosure is not limited thereto, and may also be applied to other image forming apparatuses, for example, a copying machine or a multifunction device, etc.

In the above exemplary embodiment, the photosensitive drum 51 is illustrated as a photosensitive member. However, the disclosure is not limited thereto. For example, a belt-type photosensitive member may be used as a photosensitive member.

In the above exemplary embodiment, the LED unit 40 is illustrated as an exposure device. However, the disclosure is not limited thereto. A scanner unit for emitting laser light may be used as an exposure device.

In the above exemplary embodiment, the sheet S such as a thick paper, a postcard and a thin paper is illustrated as a recording medium. However, the disclosure is not limited thereto. For example, an OHP sheet may be used.

What is claimed is:

1. An image forming apparatus comprising:

a photosensitive member whose surface is configured to be charged;

an exposure device configured to form an electrostatic latent image on the photosensitive member;

a container configured to contain developer therein;

a developing roller configured to supply the developer contained in the container to the surface of the photosensitive member;

a control device configured to control a rotational speed of the developing roller; and a temperature detector configured to detect a temperature outside of the image forming apparatus, wherein the control device is configured to:

predict, before printing a print job, whether or not a temperature of the developer carried on the developing roller during the printing of the print job, in which the developing roller is rotated at a predetermined rotational speed, will become equal to or higher than a first predetermined value by using the temperature detected by the temperature detector, rotate the developing roller at the predetermined rotational speed at least at a start of the printing of the print job in a case where it is predicted that the temperature of the developer carried on the developing roller during the printing of the print job will not become equal to or higher than the first predetermined value, and rotate the developing roller at a low speed lower than the predetermined rotational speed from the start to an end of the printing of the print job in a case where it is predicted that the temperature of the developer carried on the developing roller during the printing of the print job will become equal to or higher than the first predetermined value.

2. An image forming apparatus comprising:

a photosensitive member whose surface is configured to be charged;

an exposure device configured to form an electrostatic latent image on the photosensitive member;

a container configured to contain developer therein;

a developing roller configured to supply the developer contained in the container to the surface of the photosensitive member;

a control device configured to control a rotational speed of the developing roller; and a temperature detector configured to detect temperature, wherein the control device is configured to:

predict, before printing a print job, whether or not a temperature of the developer carried on the developing roller during the printing of the print job, in which the developing roller is rotated at a predetermined rotational speed, will become equal to or higher than a first predetermined value by using the temperature detected by the temperature detector, rotate the developing roller at the predetermined rotational speed at least at a start of the printing of the print job in a case where it is predicted that the temperature of the developer carried on the developing roller during the printing of the print job will not become equal to or higher than the first predetermined value, and rotate the developing roller at a low speed lower than the predetermined rotational speed from the start to an end of the printing of the print job in a case where it is predicted that the temperature of the developer carried on the developing roller during the printing of the print job will become equal to or higher than the first predetermined value, wherein after it is predicted, before printing the print job, that the temperature of the developer carried on the developing roller during the printing of the print job, in which the developing roller is rotated at the predetermined rotational speed, will not become equal to or higher than the first predetermined value by using the temperature detected by the temperature detector, the control device is further configured to:

determine whether or not the temperature of the developer carried on the developing roller during the printing of the print job becomes equal to or higher than a second predetermined value, and switch the rotational speed of the developing roller from the predetermined rotational speed to the low speed in a case where a first condition that the temperature of the developer carried on the developing roller during the printing of the print job becomes equal to or higher than the second predetermined value is satisfied.

3. The image forming apparatus according to claim 2, wherein whether or not the first condition is satisfied is determined by using a temperature detected inside the image forming apparatus.

4. The image forming apparatus according to claim 2, wherein the control device is configured to switch the rotational speed of the developing roller from the predetermined rotational speed to the low speed in a case where, during the printing of the print job, a second condition that an effect of the switching of the rotational speed of the developing roller on an image quality is small is satisfied in addition to the first condition.

5. The image forming apparatus according to claim 4, wherein the control device is configured to determine that the second condition is satisfied in a case where a content of the print job corresponds to at least one of a monochrome print, a text document print, and a low image quality print in which an image quality is lower than a predetermined quality.

6. The image forming apparatus according to claim 4, wherein the control device is configured to switch the rotational speed of the developing roller from the predetermined rotational speed to the low speed in response to determining that the first condition and the second condition are satisfied.

7. The image forming apparatus according to claim 4, wherein, in a case where the first condition is satisfied and the second condition is not satisfied, the control device is configured to temporarily stop the printing of the print job and determine whether or not the temperature of the developer carried on the developing roller becomes lower than a reference value, and resume the printing of the print job in a case where the temperature of the developer carried on the developing roller becomes lower than the reference value.

8. The image forming apparatus according to claim 4, wherein, in a case where the first condition is satisfied and the second condition is not satisfied, the control device is configured to switch the rotational speed of the developing roller from the predetermined rotational speed to the low speed during a time period from when the transfer of a developer image on the photosensitive member is completed till when the exposure by the exposure device is started.

9. The image forming apparatus according to claim 8, wherein, in a case where it is determined that the first condition is satisfied and the second condition is not satisfied, the control device is configured to control a conveying mechanism configured to convey a recording medium so that the time period from when the transfer of a developer image on the photosensitive member is completed till when the exposure by the exposure device is started is longer than the time period before the determination.

10. An image forming apparatus comprising:

a photosensitive member whose surface is configured to be charged;

an exposure device configured to form an electrostatic latent image on the photosensitive member;

a container configured to contain developer therein;

a developing roller configured to supply the developer contained in the container to the surface of the photosensitive member;

a control device configured to control a rotational speed of the developing roller; and a temperature detector configured to detect temperature, wherein the control device is configured to:

predict, before printing a print job, whether or not a temperature of the developer carried on the developing roller during the printing of the print job, in which the developing roller is rotated at a predetermined rotational speed, will become equal to or higher than a first predetermined value by using the temperature detected by the temperature detector;

rotate the developing roller at the predetermined rotational speed at least at a start of the printing of the print job in a case where it is predicted that the temperature of the developer carried on the developing roller during the printing of the print job will not become equal to or higher than the first predetermined value;

rotate the developing roller at a low speed lower than the predetermined rotational speed from the start to an end of the printing of the print job in a case where it is predicted that the temperature of the developer carried on the developing roller during the printing of the print job will become equal to or higher than the first predetermined value;

set a parameter, which affects a supply amount of the developer from the developing roller to the surface of the photosensitive member, to a first setting value corresponding to the predetermined rotational speed when the developing roller is rotated at the predetermined rotational speed; and set the parameter to a second setting value corresponding to the low speed when the developing roller is rotated at the low speed.

11. The image forming apparatus according to claim 10, wherein the parameter is a developing bias which is applied to the developing roller.

12. The image forming apparatus according to claim 10, further comprising a detector configured to detect a concentration of a developer image formed by supplying the developer to the surface of the photosensitive member, wherein, in a case where it is predicted that the temperature of the developer carried on the developing roller during the printing of the print job, in which the developing roller is rotated at the predetermined rotational speed, will become equal to or higher than the first predetermined value by using the temperature detected by the temperature detector, the control device is configured to, before the printing of the print job:

rotate the developing roller at the low speed, form a test electrostatic latent image on the photosensitive member, cause the detector to detect the concentration of the developer image formed by the supply of the developer from the developing roller rotating in the low speed to the test electrostatic latent image, and adjust the parameter based on a detection result of the detector.

* * * * *